US007215879B2

(12) United States Patent
Morikawa et al.

(10) Patent No.: US 7,215,879 B2
(45) Date of Patent: May 8, 2007

(54) DEFROSTING HEATER WITH CONCENTRIC GLASS TUBES SEPARATED BY END PLUGS

(75) Inventors: Yukio Morikawa, Koka-gun (JP); Ichiro Onishi, Koka-gun (JP); Toshiki Maeda, Kawanishi (JP)

(73) Assignee: Matsushita Refrigeration Company, Shiga (JP)

( * ) Notice: Subject to any disclaimer, the term of this patent is extended or adjusted under 35 U.S.C. 154(b) by 30 days.

(21) Appl. No.: 10/495,780

(22) PCT Filed: Jul. 23, 2002

(86) PCT No.: PCT/JP02/07426

§ 371 (c)(1),
(2), (4) Date: Oct. 13, 2004

(87) PCT Pub. No.: WO03/044438

PCT Pub. Date: May 30, 2003

(65) Prior Publication Data

US 2005/0069308 A1 Mar. 31, 2005

(30) Foreign Application Priority Data

Nov. 19, 2001 (JP) ..... 2001-352774

(51) Int. Cl.
*F24C 7/00* (2006.01)

(52) U.S. Cl. ..... 392/407; 219/553; 313/110

(58) Field of Classification Search ..... 392/407–408; 219/553, 541; 250/493.1, 495.1, 504 R; 313/110, 25–26, 634; 362/223–224, 362
See application file for complete search history.

(56) References Cited

U.S. PATENT DOCUMENTS

| | | | | |
|---|---|---|---|---|
| 4,324,126 | A * | 4/1982 | Riech et al. | 73/1.81 |
| 4,818,849 | A * | 4/1989 | Matlen | 392/411 |
| 5,382,805 | A * | 1/1995 | Fannon et al. | 250/504 R |
| 5,523,650 | A * | 6/1996 | Terheijden et al. | 313/578 |
| 5,915,072 | A * | 6/1999 | Campbell et al. | 392/418 |
| 6,135,620 | A * | 10/2000 | Marsh | 362/377 |
| 2004/0237560 | A1 * | 12/2004 | Onishi et al. | 62/276 |

FOREIGN PATENT DOCUMENTS

| | | |
|---|---|---|
| GB | 908793 | * 10/1962 |
| GB | 2176587 | * 12/1986 |
| JP | 48-063339 | 8/1973 |
| JP | 11-257831 A | 9/1999 |
| JP | 2002-329570 | * 11/2002 |

OTHER PUBLICATIONS

International Search Report for application No. PCT/JP02/07426 dated Oct. 29, 2002.
Microfilm of the specification and drawings annexed to the request of Japanese Utility Model Application No. 51025/1989 (Laid-Open No. 144385/1990), (Fujitsu General Ltd.), Dec. 7, 1990 and a partial English translation.

* cited by examiner

*Primary Examiner*—Thor S. Campbell
(74) *Attorney, Agent, or Firm*—RatnerPrestia

(57) ABSTRACT

A defrost heater, in which the strength of an insertion force needed for inserting a second glass tube in a plug is specified to be smaller than that needed for inserting a first glass tube in a plug. Thereby, dispersion in the insertion force needed for attaching the plug with a double glass tube can be reduced, and the assembling efficiency is improved.

11 Claims, 6 Drawing Sheets

DEFROSTING HEATER WITH CONCENTRIC GLASS TUBES SEPARATED BY END PLUGS

This Application is a U.S. National Phase Application of PCT International Application PCT/JP02/07426.

1. Technical Field

The present invention relates to a defrost heater for removing frosts sticking to cooling device of a refrigeration cycle in which an inflammable refrigerant is used.

2. Background Art

FIG. 9 is a cross sectional view showing part of a conventional defrost heater used in a refrigerator which uses an inflammable refrigerant, as disclosed in the Japanese Laid-open Patent No. H11-257831. A heater 100 made of a resistive metal is housed in a first glass tube 101, which tube is further covered with a second glass tube 102 and a third glass tube 103; thus, it is formed in a multiple structure.

The multiple tube consisting of the first glass tube 101, the second glass tube 102 and the third glass tube 103 is sealed at both ends with a rubber plug 104 so as to prevent an inflammable refrigerant from sneaking into inside of the glass tube. The air inside the first glass tube 101 is evacuated so that temperature of the glass surface does not become too high. The multiple-structured glass tube prevents surface temperature of the third glass tube 103, which glass tube may be exposed to an environment of inflammable refrigerant, from reaching a combustible temperature of inflammable refrigerant.

Since the third glass tube 103 has a larger outer diameter, dispersion in the dimensions is great, and it has a larger contact area with the plug 104. As a result, when attaching the plug 104 to the multiple glass tube, a force needed for insertion disperses wide in relation to the third glass tube 103. If it is designed so that a necessary fitting strength can be secured with the fitting force at its lowest dispersion, a very high insertion force will be needed at the highest dispersion. This deteriorates the overall efficiency of assembly operation, and may result in an incomplete plug insertion to the glass tube, or even a damaged glass tube.

DISCLOSURE OF THE INVENTION

The present invention addresses the above problems and aims to offer a defrost heater comprising a multiple glass tube that can be attached to a plug with ease at high operational efficiency. A defrost heater in the present invention is used for heating the cooling device of a refrigeration cycle which uses an inflammable refrigerant, for the purpose of removing frosts sticking thereto.

A defrost heater of the present invention comprises a first glass tube; a second glass tube which covers around the first glass tube; a heater wire housed in the first glass tube; a plug made of an elastic material for covering the opening at both ends of the first and the second glass tubes, the plug having a cylindrical protrusion, the inner circumferential wall of the cylindrical protrusion is making a sealing contact with the outer surface of first glass tube while the outer circumferential wall of the cylindrical protrusion is making a sealing contact with the inner surface of second glass tube; and a lead wire going through the plug to be connected to the heater wire at the end portion. Wherein, strength of the sealing contact between the second glass tube and the plug is specified to be weaker than that between the first glass tube and the plug.

With the above-described configuration, dispersion of the force needed for inserting a plug to the glass tube can be reduced, while keeping the withdrawal strength at a certain specified level high enough for preventing a plug from withdrawing. Thereby, the defrost heaters can be manufactured through a smooth and efficient assembly operation.

BEST MODE FOR CARRYING OUT THE INVENTION

Figure 1:
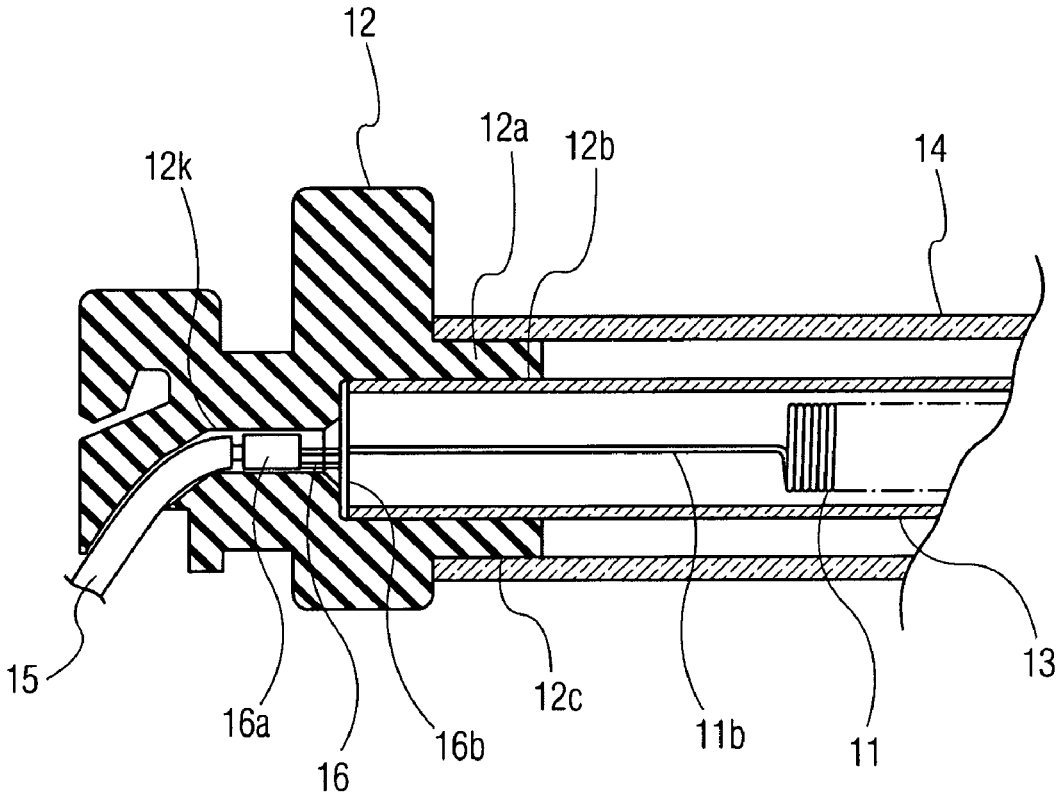
FIG. 1 is a cross sectional view showing key portion of a defrost heater in accordance with a first exemplary embodiment of the present invention.

Now in the following, the defrost heater is described in accordance with exemplary embodiments of the present invention, referring to the drawings.

EMBODIMENT 1

Figure 2:
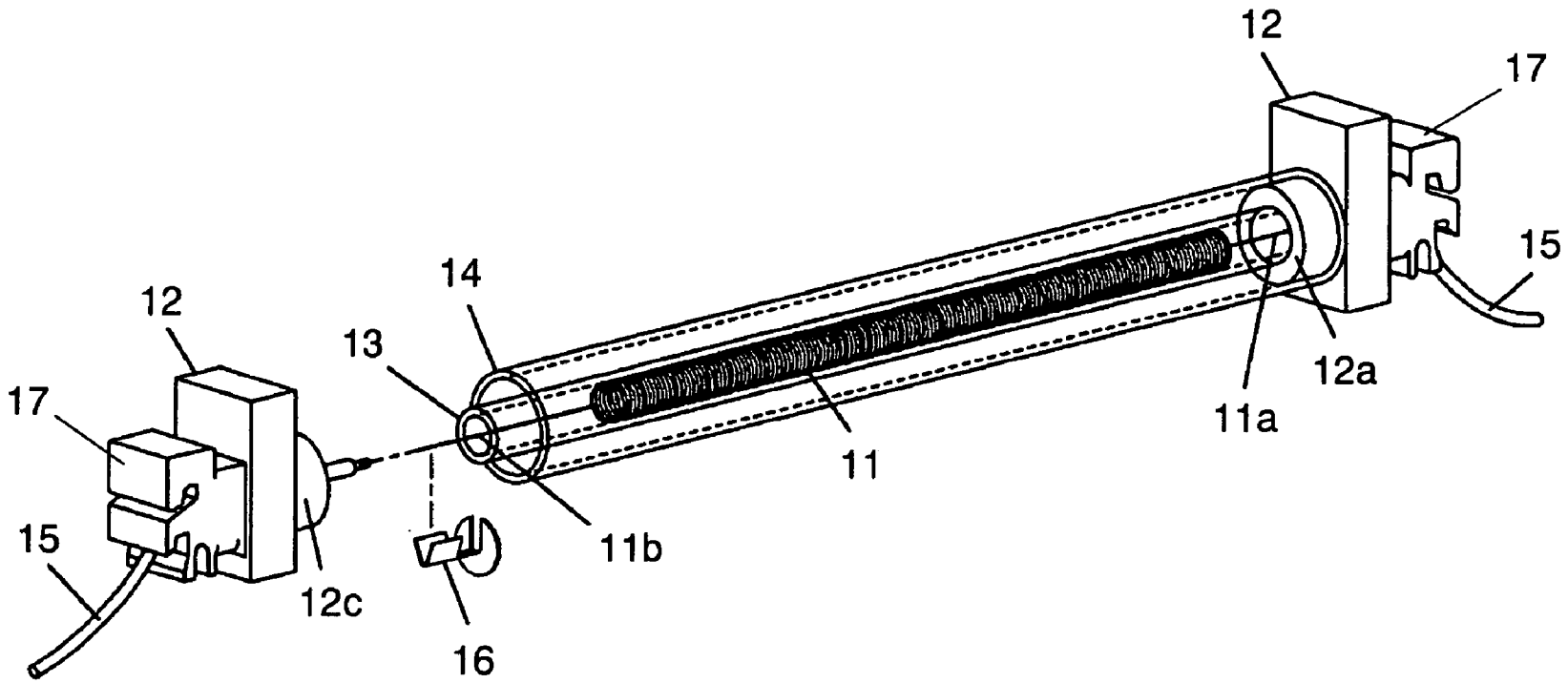
FIG. 2 is an exploded perspective view of the defrost heater, used to describe the assembly operation.
Figure 3:
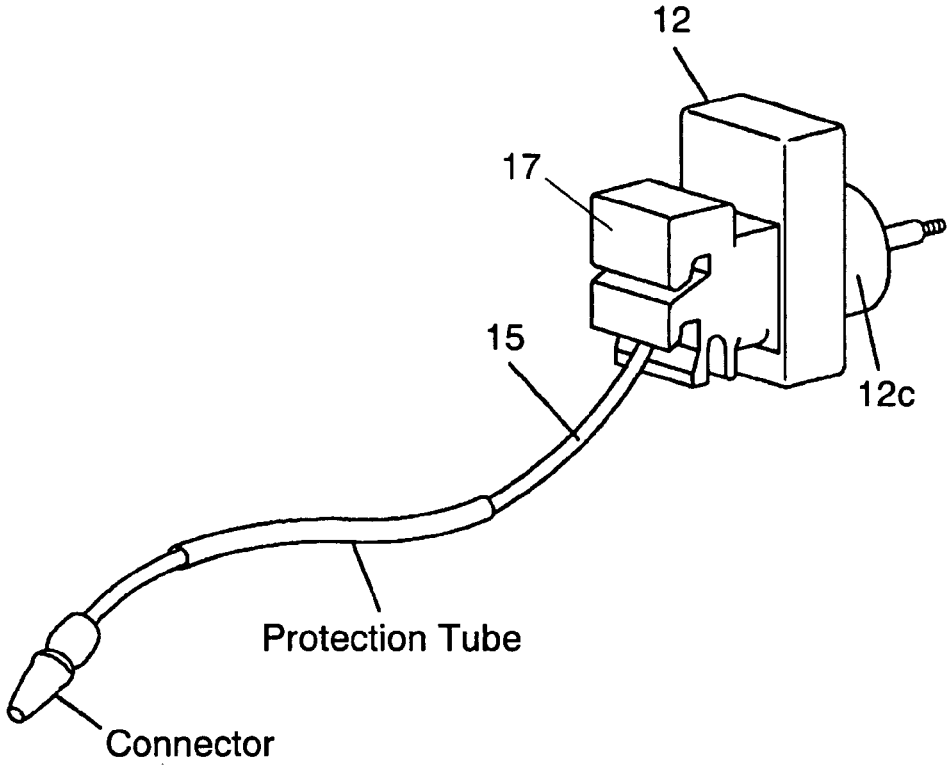
FIG. 3 is a perspective view showing a plug and a lead wire of the defrost heater.
Figure 4:
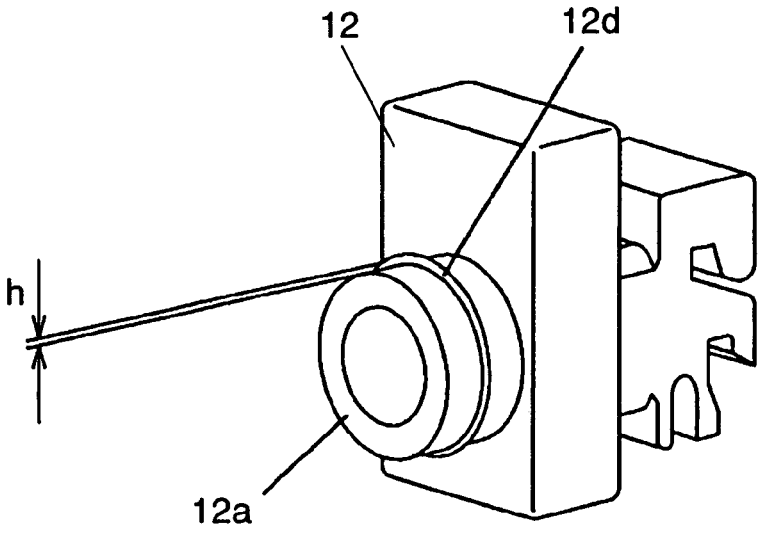
FIG. 4 is a perspective view showing a plug of the defrost heater.
Figure 5:
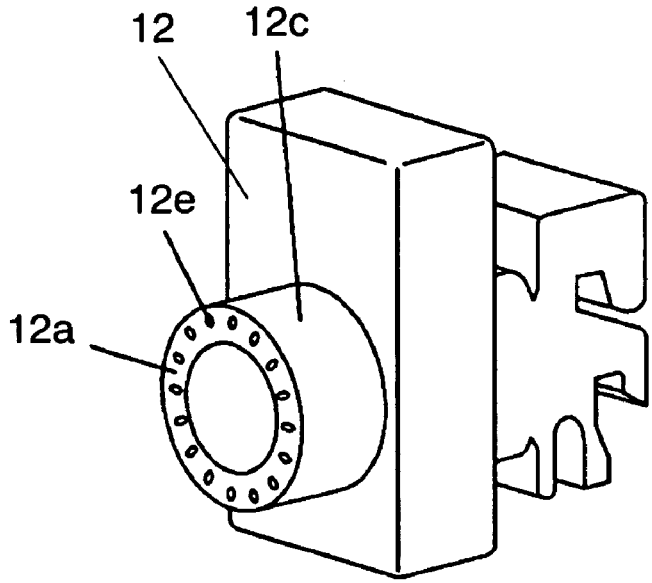
FIG. 5 is a perspective view showing a plug of the defrost heater.

FIG. 1 is a cross sectional view showing a defrost heater in accordance with a first exemplary embodiment of the present invention. FIG. 2 is an exploded perspective view of the defrost heater, used to describe the assembly operation. FIG. 3 is a perspective view showing a plug and a lead wire of the defrost heater. FIG. 4 is a perspective view showing other plug of the defrost heater. FIG. 5 is a perspective view showing a still other plug of the defrost heater.

Referring to FIG. 1 and FIG. 2, a heater wire 11 is coiled in the middle portion, accompanied by straight ends 11*a*, 11*b* having a certain specific length. A plug 12 is made of a silicone rubber or the like material that is superior in the heat resisting property and elasticity. It is provided with a cylindrical protrusion 12*a* for fixing the glass tube; diameter at the inner wall 12*b* is 9.6 mm, that at the outer wall 12*c* is 16.7 mm. A first glass tube 13 is a glass cylinder with the outer diameter 10.5 mm, which contains the heater wire 11 within inside. The first glass tube 13 is fitted with the plug along the inner wall 12*b*. A second glass tube 14 is a glass cylinder with the inner diameter 17 mm, which houses the first glass tube 13 and fitted with the plug along the outer wall 12*c*.

The first glass tube 13 has a longer overall length than the second glass tube 14. Lead wire 15 is provided through the plug 12 at a lead wire hole 12*k* for making electrical connection with the heater 11. A conductive connection terminal 16, which is consisting of a caulking section 16*a* and a stopper section 16*b* which being an extension of the caulking section 16*a*, is used for connecting the heater wire 11 and the lead wire 15. The caulking section 16*a* electrically connects the heater wire 11 with the lead wire 15; while the stopper section 16*b*, whose size is identical to or slightly smaller than the outer diameter of first glass tube 13, sets a right positioning for the heater 11.

The above-configured defrost heater is assembled in the following steps:

(a) As illustrated in FIG. 3, the lead wire 15 is provided through the plug 12 for making a lead wire assembly 17. Depending on needs, the lead wire 15 may be provided with an input connector and a protection tube.

(b) The lead wire assembly 17 is attached to the heater wire 11 at one end 11*a* (ref FIG. 2), using a connection terminal 16 (not shown in FIG. 2).

(c) The heater wire 11 is inserted in the first glass tube 13, and the first glass tube 13 is fixed to the plug 12 in the right (FIG. 2).

(d) The second glass tube 14 is fixed to the right plug 12 (FIG. 2).

(e) The other end 11*b* of heater wire 11 is drawn out of first glass tube 13 to be connected to a lead wire assembly 17 via connection terminal 16 (FIG. 2).

(f) Finally, a plug 12 for the left is attached to the first glass tube 13 and the second glass tube 14, simultaneously.

Since inner diameter of the inner wall 12*b* of cylindrical protrusion 12*a* is 9.6 mm against the 10.5 mm outer diameter of the first glass tube 13, it is fitted to the first glass tube 13 with a compression for 0.9 mm. Diameter of the outer wall 12*c*, the original size of which being 16.7 mm, has been enlarged to 17.3 mm as a result of insertion of the first glass tube 13; so, it is fitted to the second glass tube 14, whose inner diameter is 17 mm, with a compression for 0.3 mm.

The plug 12 needs to withstand a pulling force of approximately 50N so that it does not fall off a defrost heater during handling. The 50N pulling strength is secured by the first glass tube 13 which has been fitted to the plug with a higher compression, while the pulling strength provided by the second glass tube 14, which has been fitted to the plug with a less compression, is approximately 10N. The pulling strength required for preventing the plug from falling off may be considered to be substantially identical to a strength needed for inserting a plug.

The tolerance allowed for the inner diameter of second glass tube 14 is ±0.2 mm; accordingly, the compression quantity may disperse in a range from 0.1 mm to 0.5 mm. It has been confirmed through experiments that it provides an insertion force of approximately 25N, when the compression quantity is 0.5 mm. It has also been confirmed that the insertion strength of second glass tube 14 reaches approximately 100N, when the compression quantity is approximately 1.0 mm. This indicates that the insertion strength per unit compression quantity becomes high as the result of an increasing compression quantity.

Therefore, it is known that a shift in the insertion strength is less when the compression quantity is in a low level. For example, when the compression quantity is in a level of 0.3 mm, the insertion strength shifts by approximately 5N at each change of 0.1 mm; whereas, when the compression quantity is in a level of 1.0 mm, the insertion strength shifts by approximately 20N at each change of 0.1 mm.

Thus, the dispersion in the insertion strength of plug 12 can be made smaller by specifying the compression quantity in relation to the second glass tube 14 to be smaller than that in relation to the first glass tube 13. The reduced dispersion improves the efficiency of assembly operation. Namely, the operation efficiency improves when the strength of sealing contact between plug 12 and second glass tube 14 is smaller than that between plug 12 and first glass tube 13.

The second glass tube 14 has greater dimensions, which implies a greater dimensional dispersion. In the same token, the outer wall 12*c* of plug 12 has greater dimensions, which means a greater dimensional dispersion. Therefore, dispersion in the compression quantity in relation to a second glass tube 14 is much greater than that in relation to a first glass tube 13. In a case where it is designed to secure a minimum required pulling strength with a compression quantity at its smallest dispersion, the efficiency of assembly operation is impaired when the compression quantity increased.

In order to provide a favorable assembly efficiency, the fitting between the second glass tube 14 and the plug 12 may be designed within a small compression range, where the shift of insertion strength is less sensitive to a change in compression quantity.

Since the first glass tube 13 is longer than the second glass tube 14, it is easy to insert a plug 12 in the left (FIG. 2) to the first glass tube 13 and then to the second glass tube 14 consecutively. Providing a ring protrusion 12*d* on the outer surface 12*c*, as illustrated in FIG. 4, is an effective measure for preventing a dispersion in the insertion strength from becoming wild, even when the compression quantity in relation to the second glass tube 14 dispersed. The ring protrusion 12*d* is compressed to make a contact sealing with the second glass tube 14. Since the area of compression is small, dispersion in the insertion strength remains reasonable even when the second glass tube 14 has a substantially great dimensional dispersion. If the height h of ring protrusion 12*d* is specified to be greater than a tolerance in the inner diameter of second glass tube 14, a contact sealing with the second glass tube 14 can be accomplished by a compression in the ring protrusion 12*d* alone, without the cylindrical protrusion 12*a* being compressed. Thus a dispersion in the insertion strength can be reduced.

It is not essential for the ring protrusion 12*d* to be disposed to cover the entire circumference of cylindrical protrusion 12*a*; it may take a shape of partial ring, or it may be provided in a plurality, for generating the same effect.

Furthermore, a dispersion in the insertion strength in relation to the second glass tube 14 may be reduced also by means of a hollow or a hole 12*e* provided in the end-face of cylindrical protrusion 12*a*, as shown in FIG. 5. The hole 12*e* disposed at a location close to the outer circumference 12*c* makes the surface to have more elasticity.

As a result, it contributes to weaken the insertion strength of the second glass tube 14, and dispersion of the insertion strength becomes smaller. The hollow 12*e* can either be a circular groove or a partial groove.

EMBODIMENT 2

Figure 6:
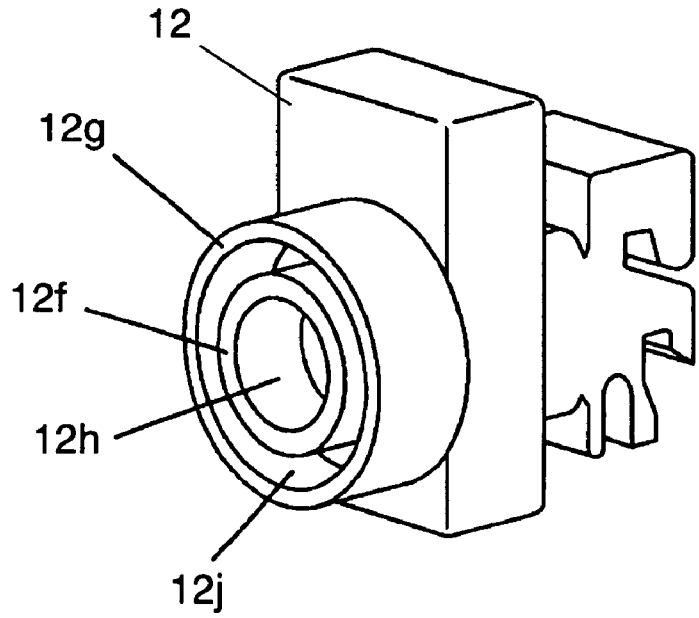
FIG. 6 is a perspective view showing a plug of defrost heater in accordance with a second exemplary embodiment of the present invention.

FIG. 6 is a perspective view showing a plug 12 of defrost heater in accordance with a second exemplary embodiment of the present invention. The plug 12 has two cylindrical protrusions 12*f*, 12*g* disposed concentric, as shown in FIG. 6. The plug 12 supports the first glass tube 13 and the second glass tube 14 at the inner circumference 12*h* and 12*j*, respectively.

Since each of the respective glass tubes is supported by an independent cylindrical protrusion, an inserted first glass tube 13 does not influence a force needed to insert a second glass tube 14. Thus, dispersion in the force needed for inserting the second glass tube 14 is reduced, and the assembly efficiency is improved.

EMBODIMENT 3

Figure 7:
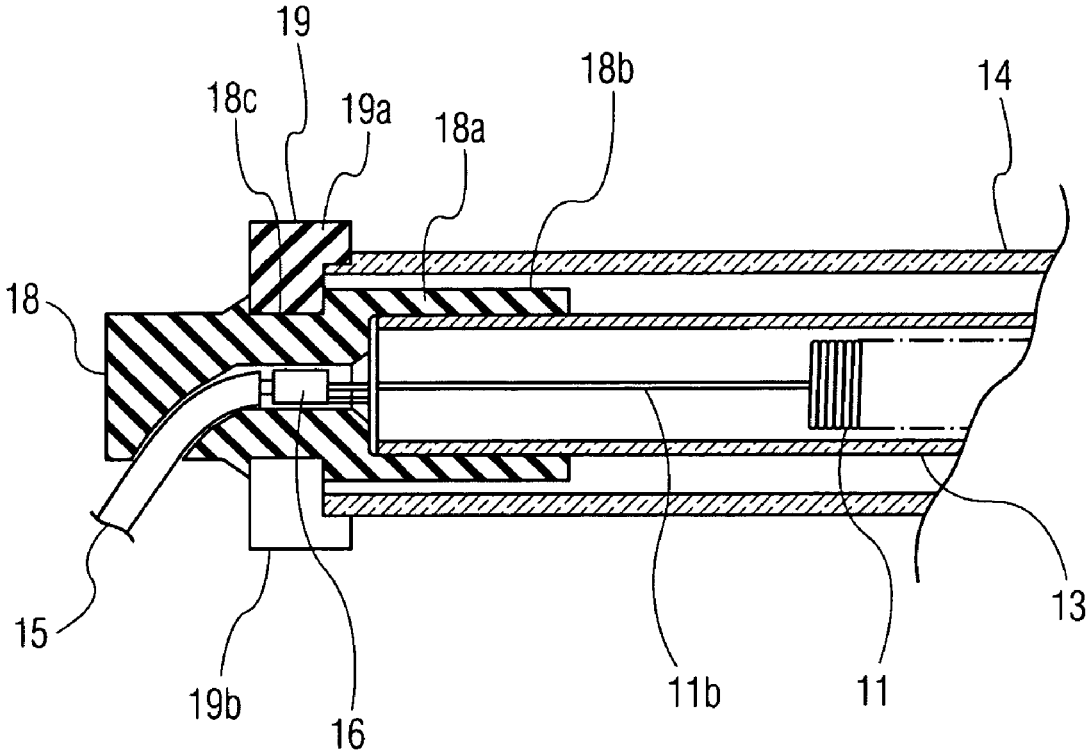
FIG. 7 is a cross sectional view showing key part of a defrost heater in accordance with a third exemplary embodiment of the present invention.
Figure 8:
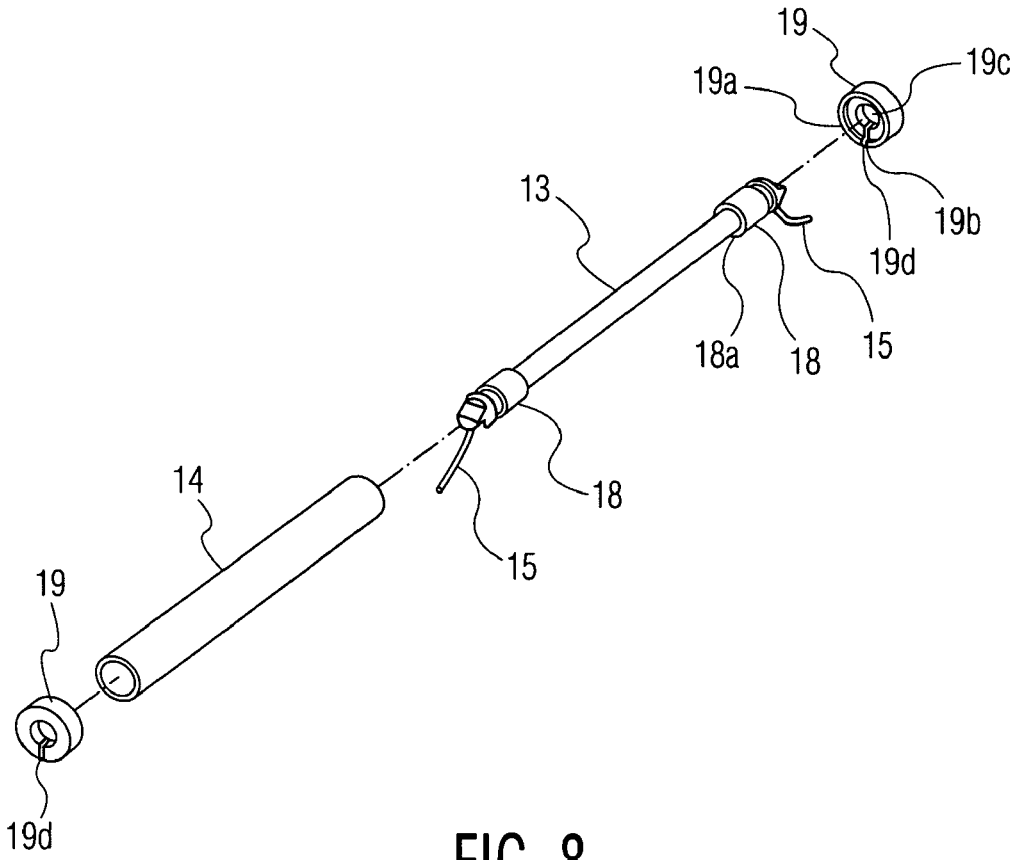
FIG. 8 is a perspective view used to describe a method of assembling the defrost heater.
Figure 9:
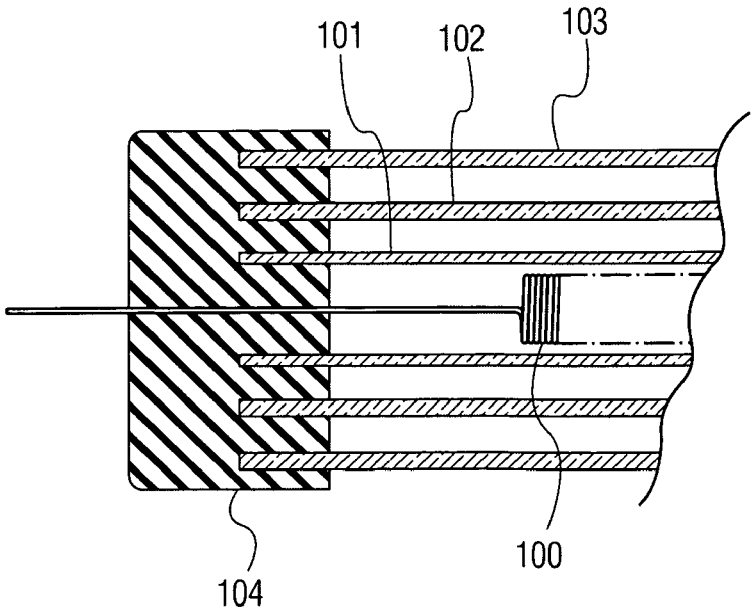
FIG. 9 PRIOR ART
FIG. 9 is a cross sectional view showing key part of a conventional defrost heater.

FIG. 7 is a cross sectional view showing part of a defrost heater in accordance with a third exemplary embodiment of the present invention. FIG. 8 is a perspective view used to describe a method of assembling the defrost heater. In FIG. 7 and FIG. 8, those constituent parts identical to those of the foregoing embodiments are represented by using the same symbols, and detailed description of which is eliminated.

A first plug 18 is made of a silicone rubber or the like material superior in the heat withstanding property and the elasticity. The first plug 18 supports the first glass tube 13 with the cylindrical protrusion 18*a*. A second plug 19 is made of said silicone rubber or a heat-resistive plastic material, and supports the second glass tube 14 with a cylindrical protrusion 19*a*. The second plug 19 has a slit 19*d* provided from the outer circumference 19*b* towards the central portion 19*c*, which slit 19*d* allows a lead wire 15 to go through when it is attached to the first plug 18.

The above-configured defrost heater is assembled through the same process steps as described in the embodiment 1, excluding the second glass tube 14 and the second plug 19. Thereafter, a second glass tube 14 is attached to the second plug 19 to complete a finished defrost heater, as shown in FIG. 8.

The second plug 19 is attached to the first plug 18 at a section 18*c*, which is a place irrelevant to mounting of the first glass tube 13. Therefore, an already mounted first glass tube 13 does not ill-affect the operation of mounting a second glass tube 14. So, efficiency of the assembly operation is improved.

Furthermore, since resistance value and electrical conduction of the heater wire can be inspected before a second glass tube 14 is mounted, there will be a greater freedom in the manufacturing process flow. Defrost heaters for use in conventional refrigerators, which refrigerators do not use inflammable refrigerant, employ only the first glass tube alone.

The defrost heaters in the present embodiment can be manufactured on an assembly line for conventional defrost heaters, by just adding an operation step for mounting the second glass tube.

INDUSTRIAL APPLICABILITY

The present invention offers defrost heaters for use in the refrigerator that employs an inflammable refrigerant, which defrost heaters can be assembled with ease at high efficiency.

The invention claimed is:

1. A defrost heater for removing frosts sticking to a cooling device among the refrigeration cycle which uses an inflammable refrigerant comprising;

a first glass tube, a second glass tube surrounding said first glass tube, a heater wire housed in the first glass tube, two plugs made of an elastic material, each of said plugs covering an opening at a respective end of said first and second glass tubes, and a lead wire passing through said plug, said lead wire connected with said heater wire at an end portion; wherein said first glass tube has an overall length that is longer than that of said second glass tube, so that, after said first glass tube and next said second glass tube are inserted at one end to one of said plugs, an other of said plugs at an other end can be fitted to said first glass tube and next to said second glass tube in a continual process;

said plugs are provided with a cylindrical protrusion, which cylindrical protrusion forming at the inner wall surface a sealing contact with the outer surface of said first glass tube while at the outer wall surface a sealing contact with the inner surface of said second glass tube, a strength of the sealing contact between said plugs and said second glass tube being weaker than that between said plugs and said first glass tube; and wherein a quantity of compression caused on the cylindrical protrusion by the inner surface of said second glass tube as a result of insertion of said second glass tube is smaller than a quantity of compression caused on the cylindrical protrusion by the outer surface of said first glass tube as a result of insertion of said first glass tube.

2. The defrost heater recited in claim 1, wherein said plugs are provided at the outer surface of the cylindrical protrusion with a ring protrusion.

3. The defrost heater of claim 2, wherein a height of the ring protrusion is greater than range of an allowable tolerance with respect to the inner diameter of a said second glass tube.

4. The defrost heater recited in claim 1, wherein said plugs are provided at the end-face of the cylindrical protrusion with a hollow.

5. The defrost heater of claim 4, wherein the hollow is located close to the outer circumference of the cylindrical protrusion.

6. A method for manufacturing a defrost heater of claim 1, wherein a first glass tube is attached to one of said plugs first, then a second glass tube is attached to there covering said first glass tube, and then finally the other said plug is attached to said first glass tube and said second glass tube.

7. The defrost heater recited in claim 1, wherein said plugs are provided at the outer surface of cylindrical protrusion with a ring protrusion.

8. The defrost heater recited in claim 1, wherein said plugs are provided at the end-face of the cylindrical protrusion with a hollow.

9. A method for manufacturing a defrost heater of claim 1, wherein a first glass tube is attached to one of said plugs first, then a second glass tube is attached thereto covering said first glass tube, and then finally the other of said plugs is attached to said first glass tube and said second glass tube.

10. A defrost heater for removing frosts sticking to a cooling device among the refrigeration cycle using an inflammable refrigerant comprising;

a first glass tube, a second glass tube which covers around said first glass tube, a heater wire housed in said first glass tube, two plugs made of an elastic material, each of said plugs covering an opening at a respective end of said first and second glass tubes, and a lead wire passing through said plug, said lead wire connected with the heater wire at the end portion; wherein at least one of said plugs consisting of a first plug portion which allows the lead wire to pass through and supports said first glass tube and a second plug portion attached to said first plug for supporting said second glass tube, wherein the second plug is provided with a slit formed from the outer circumference towards the central part for allowing a lead wire to pass through.

11. A method of manufacturing a defrost heater for removing frosts sticking to a cooling device among the refrigeration cycle using an inflammable refrigerant comprising; a first glass tube, a second glass tube which covers around said first glass tube, a heater wire housed in said first glass tube, a plug made of an elastic material for sealing the opening at both ends of said first and second glass tubes, and a lead wire which is going through said plug to be connected with the heater wire at the end portion, wherein either one, or both, of said plug is consisting of a first plug which allows the lead wire to go through and supports said first glass tube and a second plug attached to said first plug for supporting said second glass tube, the method comprising the steps of, first attaching a first plug portion to a first glass tube, then, attaching a second glass tube covering a first glass tube, and then, attaching the second plug portion.

* * * * *